US008789835B2

(12) United States Patent
Abel et al.

(10) Patent No.: US 8,789,835 B2
(45) Date of Patent: Jul. 29, 2014

(54) ROLLER SKATE

(75) Inventors: Helmut Abel, Maison-Laffitte (FR); Diane Abel, Maison-Laffitte (FR); Céline Abel, Maison-Laffitte (FR)

(73) Assignee: Helmut Abel, Maison-Laffitte (FR)

( * ) Notice: Subject to any disclaimer, the term of this patent is extended or adjusted under 35 U.S.C. 154(b) by 37 days.

(21) Appl. No.: 13/541,264

(22) Filed: Jul. 3, 2012

(65) Prior Publication Data

US 2013/0009369 A1 Jan. 10, 2013

(30) Foreign Application Priority Data

Jul. 5, 2011 (DE) ..... 10 2011 078 633

(51) Int. Cl.
*A63C 17/02* (2006.01)
*A63C 17/00* (2006.01)

(52) U.S. Cl.
USPC ..... 280/11.223; 280/11.221; 280/11.19; 280/11.222

(58) Field of Classification Search
USPC ..... 280/11.221, 841, 11.222, 11.223, 280/11.224, 11.231, 11.27, 11.19
See application file for complete search history.

(56) References Cited

U.S. PATENT DOCUMENTS

| | | | | |
|---|---|---|---|---|
| 208,235 | A | 9/1878 | Gregg | |
| 233,845 | A | 11/1880 | Gregg | |
| 1,017,162 | A | 2/1912 | Naumann | |
| 1,379,250 | A | 5/1921 | Clark | |
| 2,430,037 | A | 11/1947 | Vincent | |
| 3,339,936 | A * | 9/1967 | Hamlin | 280/11.207 |
| 4,394,028 | A * | 7/1983 | Wheelwright | 280/11.19 |
| 5,183,276 | A | 2/1993 | Pratt | |
| 5,224,718 | A | 7/1993 | Gertler | |
| 5,251,920 | A * | 10/1993 | McHale | 280/11.19 |

(Continued)

FOREIGN PATENT DOCUMENTS

| | | |
|---|---|---|
| DE | 295 05 984 | 8/1996 |
| DE | 29620280 | 1/1997 |

(Continued)

OTHER PUBLICATIONS

European Patent Office, "Search Report" in European Patent Application No. 12 179 879.7, Document of 4 pages, dated Mar. 21, 2013.

(Continued)

*Primary Examiner* — J. Allen Shriver, II
*Assistant Examiner* — James M Dolak
(74) *Attorney, Agent, or Firm* — Akerman LLP; Peter A. Chiabotti

(57) ABSTRACT

The described roller skate is essentially composed of a boot, to the sole of which the plate of a roller carrier element is detachably connected with screws penetrating the through holes. The screw holes are located on both sides of the vertical symmetry axis on the center longitudinal line. Bearing blocks and are connected to the underside of the plate via a web extending in the longitudinal direction. The floating axles of the inline rollers and of the outer rollers are inserted in bores through or through. The bearing blocks and with their different bores through or through are likewise embodied and arranged in a mirror symmetrical manner with respect to the vertical center line. The explained symmetry of the roller carrier element makes it possible for it to be used for the left and right roller skate.

20 Claims, 3 Drawing Sheets

(56) References Cited

U.S. PATENT DOCUMENTS

| | | | | |
|---|---|---|---|---|
| 5,303,940 | A | 4/1994 | Brandner | |
| 5,312,120 | A | 5/1994 | Wiegner | |
| 5,346,231 | A * | 9/1994 | Ho | 280/11.208 |
| 5,348,321 | A * | 9/1994 | Sbrilli | 280/11.222 |
| 5,551,713 | A | 9/1996 | Alexander | |
| 5,566,957 | A * | 10/1996 | Ho | 280/11.223 |
| 5,816,588 | A * | 10/1998 | Nicoletti | 280/11.231 |
| 5,908,196 | A | 6/1999 | Weiss | |
| 5,927,729 | A * | 7/1999 | Di Filippo et al. | 280/11.3 |
| 5,951,028 | A | 9/1999 | Lovitt et al. | |
| 6,070,885 | A | 6/2000 | Ferone | |
| 6,116,620 | A * | 9/2000 | Gabrielli | 280/11.19 |
| 6,273,437 | B1 | 8/2001 | Lovitt et al. | |
| 6,398,229 | B1 | 6/2002 | Saylor | |
| 6,422,578 | B1 | 7/2002 | Oh | |
| 6,443,464 | B2 | 9/2002 | Lovitt et al. | |
| 6,467,777 | B2 | 10/2002 | Teyhen | |
| 6,698,776 | B2 | 3/2004 | Todd | |
| 6,722,670 | B1 | 4/2004 | Lee | |
| 6,755,425 | B2 * | 6/2004 | Gorisch | 280/11.27 |
| 6,834,866 | B2 * | 12/2004 | van Egeraat | 280/11.221 |
| 6,874,795 | B2 | 4/2005 | Sung | |
| 7,104,549 | B2 * | 9/2006 | Eun et al. | 280/11.28 |
| 7,175,187 | B2 | 2/2007 | Lyden | |
| 7,523,948 | B1 | 4/2009 | Wright | |
| 7,758,054 | B2 * | 7/2010 | Abel et al. | 280/11.222 |
| 2002/0125658 | A1 | 9/2002 | Alwarid | |
| 2002/0125659 | A1 * | 9/2002 | Page et al. | 280/11.211 |
| 2003/0057665 | A1 | 3/2003 | Matney | |
| 2008/0185798 | A1 | 8/2008 | Abel et al. | |
| 2009/0079147 | A1 | 3/2009 | Conners et al. | |

FOREIGN PATENT DOCUMENTS

| | | |
|---|---|---|
| DE | 29920398 | 3/2000 |
| DE | 102005059069 | 3/2008 |
| WO | 97/00104 | 1/1997 |
| WO | 99/04871 | 2/1999 |
| WO | 02/068070 | 9/2002 |
| WO | 2004/110574 | 12/2004 |

OTHER PUBLICATIONS

German Patent & Trademark Office, "Office Action," by Examiner Baker, Ines, dated Feb. 27, 2014, in German Patent Application No. DE10 2011 078 633.3, Document of 8 pages.

* cited by examiner

ROLLER SKATE

CROSS REFERENCE TO RELATED APPLICATIONS

This application claims priority to German Patent Application No. DE 10 2011 078 633.3 filed Jul. 5, 2011, which is hereby incorporated by reference in its entirety.

FIELD OF INVENTION

The invention relates to roller skates.

BACKGROUND

A type of roller skate is known from DE 10 2005 059 069 B4. This roller skate has a boot, to the sole of which a roller carrier element is attached, on which outer rollers are provided in the region of the outside of the boot and inline rollers are provided under the boot.

The asymmetrical arrangement of the rollers means that different roller carrier elements are necessary for the left and the right roller skate of a pair, which are identical only in a mirror-image manner. However, this means that different tools, in particular different injection molds, are necessary for the manufacture of the roller carrier elements for the right and the left skate.

In addition, the roller carrier elements must also be varied for roller skates of different sizes, i.e., for different boot lengths. This leads to a further multiplication of the tools and thus of the production costs.

SUMMARY

An object of the present application, based on the above-referenced known roller skate, is to create a roller carrier element that is suitable for the right and left roller skate.

Another object of the present application is to design the roller carrier element such that it is suitable for assembly on boots of different sizes.

This object is attained by the features of which a largely symmetrical roller carrier element is created, which, after rotation about 180°, can be attached to the right as well as to the left boot of the roller skate, and According to the further structures and features recited herein, the roller carrier element is designed such that the outer rollers as well as the inline rollers can be mounted at different intervals and the roller carrier element is thus suitable for assembly on boots of different sizes.

Measures further developing the inventive concept are the subject matter of the subordinate claims, the content of which is explained with the description of the exemplary embodiments.

BRIEF DESCRIPTION OF DRAWINGS

The subject matter of the present application is explained in detail below based on two preferred exemplary embodiments, which are shown in the drawings.

The drawings show.

DETAILED DESCRIPTION

Figure 1:
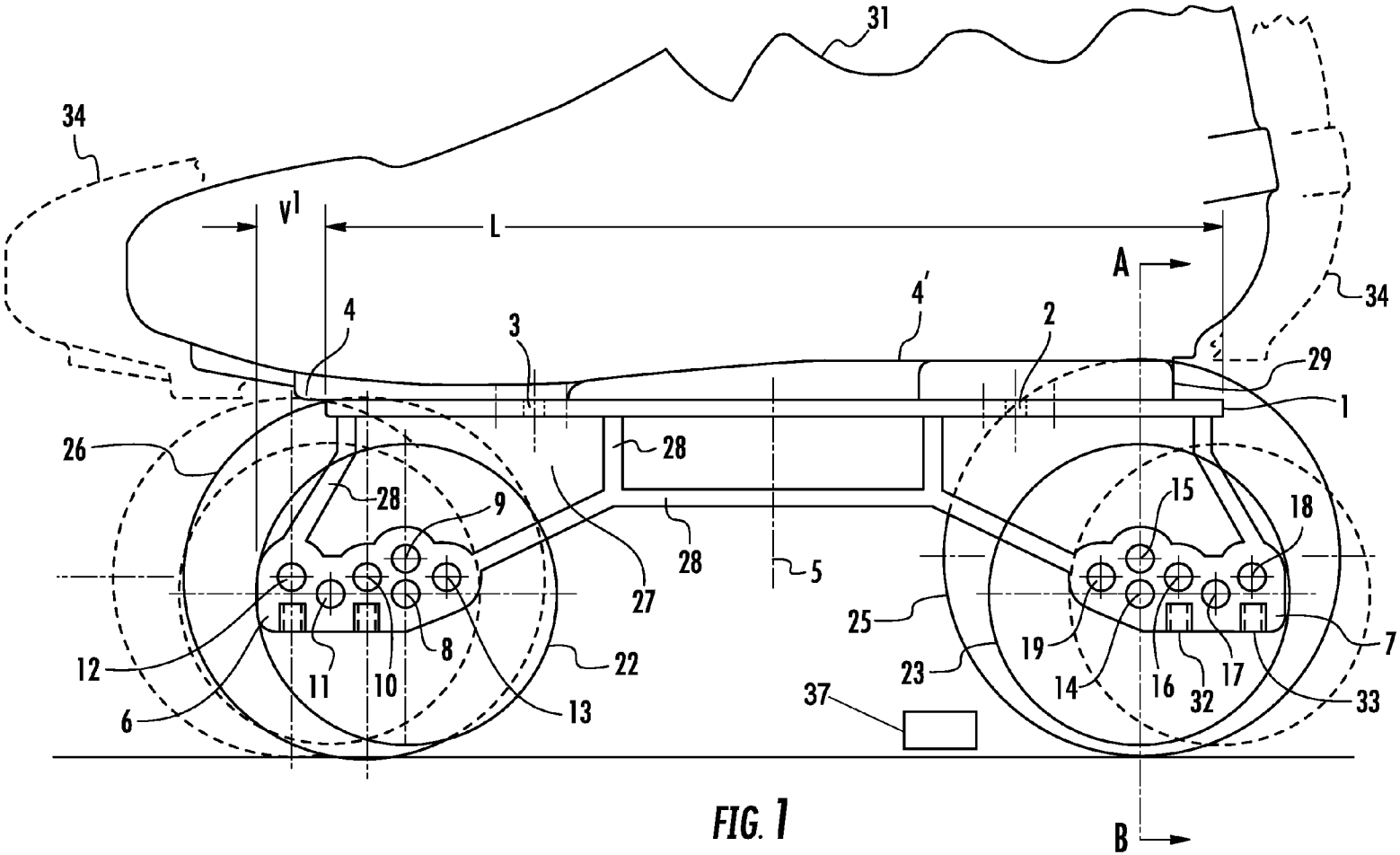
FIG. 1 a side view of a right roller skate according to the invention.

The roller skate shown in the drawings is composed essentially of a boot 31, to the sole of which a plate 1 with bearing blocks 6, 7 supporting outer rollers 25, 26 and inline rollers 22, 23 is attached as a roller carrier element. Screws, not shown, which penetrate the through holes 2, 3, are used for attachment. Expediently, further through holes, not shown, are provided. All of the through holes are arranged on both sides of the vertical symmetry axis 5 on the center line 20 of the plate 1, which is important for the reasons explained below.

A spacer washer 29 is provided on the plate 1 in the heel area of the boot 31, which spacer washer is connected to the plate 1 by means of a screw penetrating the through bore 30 (cf. FIGS. 2 and 3) and raises the boot sole 4' in the heel region with respect to the boot sole 4 in the front region.

Bearing blocks 6 and 7 are attached to the underside of the plate 1 via a vertical web 27, which bearing blocks are placed symmetrically to one another and lie in the same vertical plane. The width E of these bearing blocks 6 and 7 preferably corresponds to 75% of the width P of the plate 1.

To accommodate cantilevered axes 38 of the outer rollers 25, 26 and of the inline rollers 22, 23, the bearing blocks 6, 7 respectively have six parallel bores 8 through 13 and 14 through 19 of equal size. It is important for the invention that the bearing blocks 6 and 7 with their bores 8 through 13 or 14 through 19 are arranged in a mirror symmetrical manner to one another with regard to the vertical symmetry axis 5 and lie in a line one behind the other in the same vertical plane in the direction of movement. With regard to the boot axis or plate axis 20, the bearing block center line 21 is offset in the direction of the outside of the boot by the amount V in the direction of the outside of the boot. Preferably, this offset corresponds to approx. 30% of the width P of the plate 1.

For reasons of stability, the bearing blocks 6 and 7 are arranged with respect to the plate 1 such that their front edge or rear edge projects beyond the plate 1. Expediently, a distance of the front edge or rear edge of the bearing blocks 6 and 7 with respect to the front edge or rear edge of the plate 1 is V'=8% of the plate length L.

Figure 2:
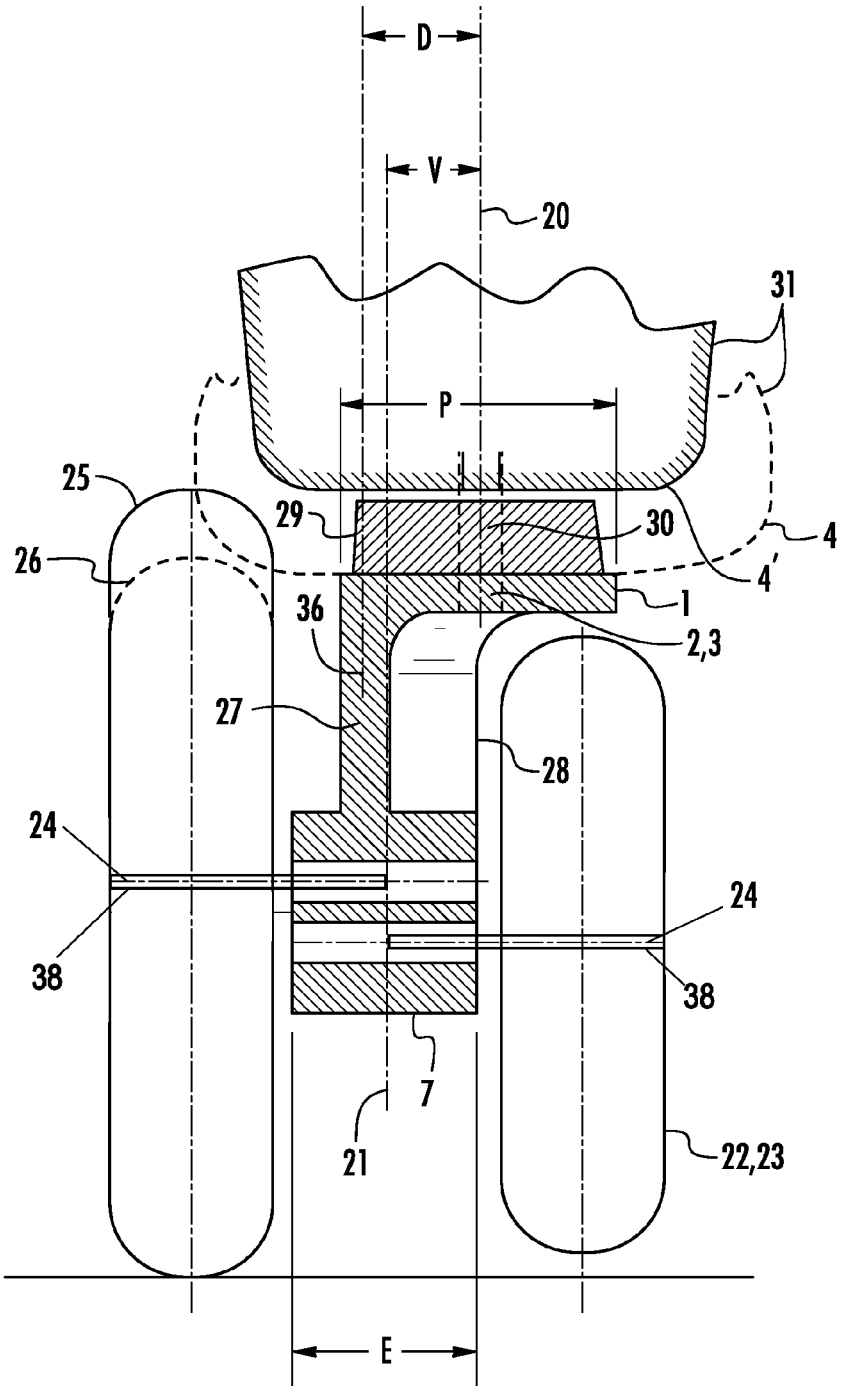
FIG. 2 a section along the line A-B in FIG. 1.
Figure 3:
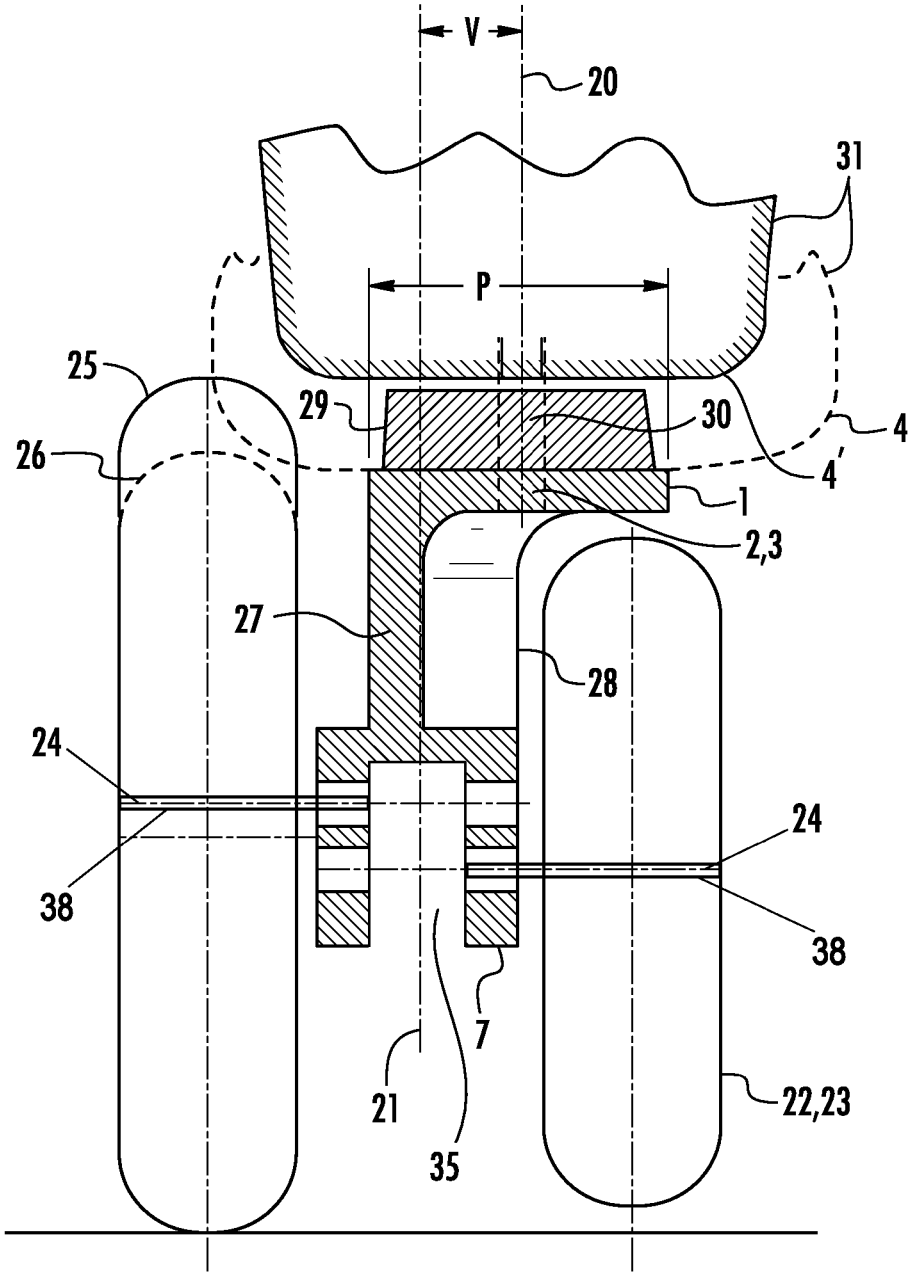
FIG. 3 a section according to FIG. 1 of an amended embodiment.

As above all FIGS. 2 and 3 show, the inline rollers 22, 23 are located below the plate 1 and are offset in the direction of the inside of the boot. They are supported on cantilevered floating axles 38 the center lines of which are shown by dash-dotted lines 24.

The larger outer rollers 25, 26 located on the outside of the boot are likewise supported on cantilevered floating axles 38 inserted into bores of the bearing blocks 6, 7, the center lines of which floating axles in turn are illustrated by dash-dotted lines 24. For reasons of the simplification of production, the floating axles of all of the rollers 22, 23, and 25, 26 are embodied in an identical manner.

The two bearing blocks 6 and 7, as mentioned at the outset, are connected to the plate 1 via the web 27, which is reinforced with strengthening ribs 28 to avoid or to reduce twisting. As FIG. 2 shows, the web 27 is arranged such that its center line 36 is offset with respect to the center line 20 of the plate 1 by the distance D to the outside of the boot. In the exemplary embodiment, the web is offset laterally up to the edge of the plate 1.

The symmetrical embodiment of the plate 1 with the bearing blocks 6 and 7 has the decisive advantage that the same roller carrier element can be used for the right and left roller skate so that, in contrast to known roller skates, only one injection mold is necessary for the production of the roller carrier elements.

In order to mount the roller carrier element shown in FIG. 1 and intended for the right roller skate on the boot of the left roller skate, the plate 1 needs only to be rotated by 180°, on which the spacer washer 29 is to be placed on the opposite side, i.e., in the heel region of the left boot. The plate 1 with the spacer washer 29 can be screwed thereon onto the sole of the left boot. Since the rollers 25 and 26 located on the outside of the boot have different diameters, they are to be exchanged. To this end, the right outer roller 25 in FIG. 1, the axis of which is supported in the bore 15, is to be mounted on the bearing block 6 located on the left side, that is, its floating axle is to be inserted into the bore 9. Accordingly, the smaller roller 26, the floating axle of which is inserted into the bore 10, is to be attached to the bearing block 7 on the right, that is, inserted with its floating axle into the bore 16. An assembly in the bores 13 and 19 located further inwards is possible if smaller outer rollers of the same diameter, e.g., with smaller boot sizes, are to be mounted at the front and at the back.

The different, differently positioned bores 8 through 13 or 14 through 19 in the bearing blocks 6 and 7 make it possible to use outer rollers and inline rollers of different diameters.

Thus rollers with much smaller diameter can also be used in order to achieve a lower center of gravity of the plate 1, which is advisable for smaller boot sizes, for nervous beginners or for skating on smooth floors.

A further advantage is that the roller carrier element designed according to the present application can also be used for different boot sizes. For example, if, as indicated by number 34 in FIG. 1, the roller carrier element is to be attached to a very long boot, e.g., size 46, then the rollers can be offset in the longitudinal direction as follows for the purpose of stabilization of the roller skate. To this end, the rear inline roller 23, the floating axle of which lies in the bore 14, is shifted further backwards such that its floating axle can be inserted into the bore 17. The roller skate is hereby completely stable against tipping back and in its longitudinal direction. In the same way, the front inline roller 22 is shifted further forwards, wherein its floating axle located in the bore 8 is inserted into the bore 11. This also contributes to the stabilization of the roller skate in the longitudinal direction. The rear large outer roller 25, the floating axle of which is inserted into the bore 15, remains unchanged, while the front outer roller 26 is shifted forwards, wherein its floating axle located in the bore 10 is inserted into the bore 12.

A roller skate embodied in the manner according to the invention is in particular suitable for users who are still growing, if they have, e.g., boot size 40 at the beginning and later need larger boots. The same roller carrier element can then be attached thereto relatively easily.

In order alternatively to also be able to equip this roller carrier element with a brake block 37, threaded bushings 32, 33 are provided on the underside of the bearing blocks 6 and 7, which threaded bushings can be used for the threaded attachment of a brake block 37.

Finally, FIG. 3 shows a slight modification of the roller carrier element. Accordingly, the bearing blocks 6, 7 are provided with slots 35 open at the bottom for weight reduction.

LIST OF REFERENCE CHARACTERS

1 Plate
2, 3 Through holes
4 Boot sole, front
4' Boot sole in the heel region
5 Vertical symmetry axis
6, 7 Bearing blocks
8 through 13 Bores in the left bearing block
14 through 19 Bores in the right bearing block
20 Boot axis or plate axis
21 Bearing block center line
22, 23 Inline rollers
24 Center line of the cantilevered axes
25, 26 Outer rollers
27 Web
28 Strengthening ribs
29 Spacer washer
30 Through hole
31 Boot
32, 33 Threaded bushing
34 Long boot
35 Slot
36 Web center line
A-B Section of the roller carrier element according to the invention in FIG. 1
V Lateral offset of the bearing blocks
V' Projection of the bearing blocks
P Plate width
L Plate length
D Offset of the web center line to the outside of the boot
E Width of the bearing blocks 6 and 7

The invention claimed is:

1. A roller skate, comprising:
a boot with a sole and an outside region;
a roller carrier element attached to the sole of the boot;
two outer rollers provided at the outside region and arranged in a line one behind the other in a direction of movement;
two inline rollers arranged under the boot and in a line one behind the other in the direction of movement;
wherein the outer rollers are supported on cantilevered axles inserted into the roller carrier element,
wherein the roller carrier element is composed of a symmetrical plate detachably connected to the sole of the boot and two bearing blocks fixedly connected to the plate, which are embodied and arranged in a mirror image manner with regard to a vertical symmetry axis of the roller skate but otherwise identically, and which to accommodate the cantilevered axles of the outer rollers and inline rollers have bores on both sides, and
wherein the bearing blocks are connected to the plate via a vertical web.

2. The roller skate according to claim 1, further comprising a through hole located at a center line of the plate on both sides of the vertical symmetry axis of the roller skate for screwing the plate onto the sole of the boot.

3. The roller skate according to claim 1, further comprising a group of through holes located on each side of the vertical symmetry axis, wherein the group of through holes are arranged in a mirror image manner to one another with respect to the symmetry axis.

4. The roller skate according to claim 3, wherein each group of through holes has six through holes.

5. The roller skate according to claim 1, further comprising a spacer washer connected to the plate under the sole of the boot in a heel region.

6. The roller skate according to claim 1, wherein the bearing blocks have different bores offset in the direction of movement and perpendicular thereto for the accommodation of the cantilevered axles.

7. The roller skate according to claim 1, wherein the web has strengthening ribs arranged spaced apart from one another.

8. The roller skate according to claim 1, wherein a center line of the web is offset outwards with respect to a vertical axis of the plate.

9. The roller skate according to claim 7, wherein a center line of the web is offset outwards with respect to the vertical axis of the plate up to the level of the outer edge of the plate.

10. The roller skate according to claim 1, wherein a center line of the bearing blocks is offset outwards with respect to the vertical axis of the plate.

11. The roller skate according to claim 1, wherein a center line of the bearing blocks is offset outwards with respect to the vertical axis of the plate, and the center line is offset outwards by 30% of a width of the plate.

12. The roller skate according to claim 1, wherein a width of the bearing blocks corresponds to 75% of a width of the plate.

13. The roller skate according to claim 1, wherein the bearing blocks project with respect to a front or rear edge of the plate.

14. The roller skate according to claim 1, wherein the threaded bushings for screwing on a brake block area are provided on the underside of the bearing blocks.

15. The roller skate according to claim 1, wherein the plate with the bearing blocks can be connected to the sole with an orientation that is reversible by 180°.

16. The roller skate according to claim 1, wherein the roller carrier element, composed of a rectangular plate, the bearing blocks and the vertical web, is a one-piece injection molded part of plastic or metal.

17. The roller skate according to claim 1, wherein the inline rollers are each of the same size, and each inline roller is smaller than the outer rollers, wherein a diameter of the rear outer roller is larger than that of the front outer roller.

18. A roller skate, comprising:

a boot with a sole and an outside region;

roller carrier element attached to the sole of the boot;

two outer rollers provided at the outside region and arranged in a line one behind the other in a direction of movement;

two inline rollers arranged under the boot and in a line one behind the other in the direction of movement;

wherein the outer rollers are supported on cantilevered axles inserted into the roller carrier element, wherein the roller carrier element is composed of a symmetrical plate detachably connected to the sole of the boot and two bearing blocks fixedly connected to the plate, which are embodied and arranged in a mirror image manner with regard to a vertical symmetry axis of the roller skate but otherwise identically, and which to accommodate the cantilevered axles of the outer rollers and inline rollers have bores on both sides, and wherein a threaded bushing for screwing on a brake block area are provided on the underside of the bearing blocks.

19. The roller skate according to claim 18, wherein the bearing blocks are connected to the plate via a vertical web.

20. The roller skate according to claim 18, wherein the plate with the bearing blocks can be connected to the sole with an orientation that is reversible by 180°.

* * * * *